US008104640B2

(12) United States Patent
Selvetti

(10) Patent No.: US 8,104,640 B2
(45) Date of Patent: Jan. 31, 2012

(54) SPRING-LOADED AMMUNITION MAGAZINE CARRIER

(76) Inventor: Michael D. Selvetti, Palm Bay, FL (US)

( * ) Notice: Subject to any disclaimer, the term of this patent is extended or adjusted under 35 U.S.C. 154(b) by 0 days.

(21) Appl. No.: 12/623,437

(22) Filed: Nov. 22, 2009

(65) Prior Publication Data

US 2010/0187271 A1 Jul. 29, 2010

Related U.S. Application Data

(60) Provisional application No. 61/117,169, filed on Nov. 22, 2008.

(51) Int. Cl.
*F42B 39/00* (2006.01)
*B65D 83/00* (2006.01)

(52) U.S. Cl. ..... 221/154; 221/279; 221/281

(58) Field of Classification Search ..... 221/154, 221/197, 198, 208, 241, 242, 244, 246, 252, 221/254–257, 260, 268, 270, 276, 279, 303, 221/312 C See application file for complete search history.

(56) References Cited

U.S. PATENT DOCUMENTS

| | | | | |
|---|---|---|---|---|
| 2,503,741 | A * | 4/1950 | Johnson | 221/303 |
| 2,779,522 | A * | 1/1957 | Puckett | 221/185 |
| 5,080,258 | A * | 1/1992 | Hinterreiter | 221/198 |
| 5,755,052 | A * | 5/1998 | Keeney | 42/50 |
| 6,000,589 | A * | 12/1999 | Burdine | 224/196 |
| 7,364,057 | B2 | 4/2008 | Carroll | |
| 2005/0189371 | A1 | 9/2005 | Harvey | |
| 2008/0099503 | A1 * | 5/2008 | Altieri et al. | 221/156 |
| 2008/0184608 | A1 * | 8/2008 | Tal et al. | 42/87 |
| 2010/0327006 | A1 * | 12/2010 | Campo | 221/185 |

* cited by examiner

*Primary Examiner* — Timothy Waggoner
*Assistant Examiner* — Kelvin L Randall, Jr.
(74) *Attorney, Agent, or Firm* — John L. DeAngelis; Beusse Wolter Sanks Mora & Maire, P.S.

(57) ABSTRACT

A system for dispensing ammunition magazines. The system includes a housing for holding the magazines with an open region defined in the housing; a spring-loaded follower imparting a force against the magazines to move a first magazine into a dispensing position for removal from the housing through the open region. A user can access the first magazine through the open region, exerting a force on the first magazine and withdrawing the first magazine through the open region.

9 Claims, 11 Drawing Sheets

SPRING-LOADED AMMUNITION MAGAZINE CARRIER

CLAIM OF PRIORITY

The present application claims the benefit, under 35 U.S.C. 119(e), of the provisional patent application filed on Nov. 22, 2008, assigned application No. 61/117,169 and entitled Spring-Loaded Ammunition Magazine Carrier.

FIELD OF THE INVENTION

The present invention relates to the field of ammunition magazines and more particularly to a carrier for holding and dispensing a plurality of ammunition magazines quickly as needed by the user.

BACKGROUND OF THE INVENTION

Users of handguns, such as hunters, competitors, soldiers and police officers often carry extra ammunition in the form of magazines to complete a task at hand. These magazines are usually loaded with a predetermined number of cartridges and are ready for use when the weapon must be reloaded. These magazines are often carried in pouches, holders or even pockets of garments worn by the user. Most holders or pouches tend to be worn on a belt, accessible on the weak or off-hand side of a user. This allows a user to maintain control of the handgun with his/her strong hand while retrieving a magazine with the off-hand. More often then not, when a reload is required, speed is a priority and in some circumstances a lack of speed may cause injury or death. With the currently available types of magazine holders on the market, the magazines are usually covered by a flap and tend to be placed or spread around the waist. This requires the user to open the flap, look in pockets and even search for the next available magazine around the waist.

Accordingly, it would be advantageous to provide a system or method that addresses the above-noted disadvantages of the prior art, and makes it easier and more efficient to locate an ammunition magazine when needed.

BRIEF DESCRIPTION OF THE DRAWINGS

The present invention can be more easily understood and the advantages and uses thereof more readily apparent when the following detailed description of the present invention is read in conjunction with the figures wherein.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Figure 1:
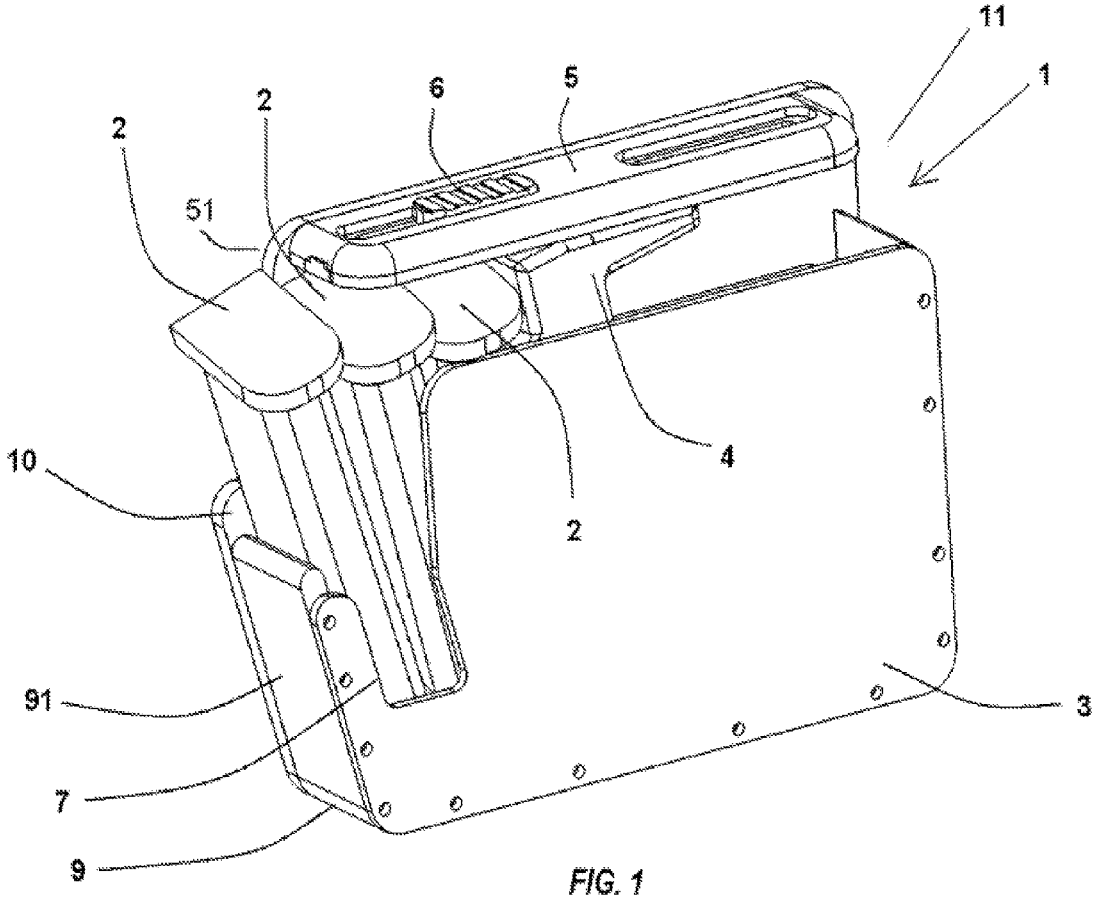
FIG. 1 is an offset front view of the carrier of the present invention storing a quantity of magazines.

Before describing in detail the ammunition magazine carrier of the present invention, it should be observed that the present invention resides primarily in a novel and non-obvious combination of elements. So as not to obscure the disclosure with details that will be readily apparent to those skilled in the art, certain conventional elements are presented with lesser detail, while the drawings and the specification describe in greater detail other elements and steps pertinent to understanding the invention.

The following embodiments are not intended to define limits of the structure or method of the invention, but only to provide exemplary constructions. The embodiments are permissive rather than mandatory and illustrative rather than exhaustive.

The present invention attempts to overcome the problem of searching for an ammunition magazine "somewhere on the waist," by positioning the magazine in a known location so it can be accurately and quickly accessed by the user each time a new magazine is needed. Also, the present invention allows the magazines to be quickly dispensed and provides multiple openings for spare magazines, depending on the user's needs. These features increase both access and speed when the user must reload quickly.

One embodiment of the present invention provides a system for individually dispensing ammunition magazines. The system includes a housing to hold the ammunition magazines. The housing has a front surface, a back surface, a top surface, a bottom surface, a first side and a second side. One or more openings are formed within the housing adjacent to the first side. The system further includes a spring-loaded follower to impart a force on the ammunition magazines in a direction of the first side of the housing, such that a first ammunition magazine aligned in a dispensing position, which is adjacent to the first side and the opening(s). Upon removal of the first ammunition magazine from the dispensable position of the housing through the opening(s), the force shifts the ammunition magazines in the direction toward the first side such that a second ammunition magazine is aligned in the dispensing position. The second ammunition magazine had been aligned adjacent to the first ammunition magazine prior to the removal of the first ammunition magazine through the opening(s).

Another embodiment of the present invention provides a method for individually dispensing ammunition magazines. The method includes the steps of holding the ammunition magazines within a housing, where the housing has a front surface, a back surface, a top surface, a bottom surface, a first side and a second side. Additionally, the method includes forming one or more openings within the housing adjacent to the first side. Additionally, the method includes imparting a force on the ammunition magazines in a direction of the first side, such that a first ammunition magazine is aligned in a dispensing position adjacent to the first side and the opening (s). Additionally, the method includes removing the first ammunition magazine from the dispensing position of the housing through the opening(s) and imparting a force on the ammunition magazines in the direction of the first side, such that a second ammunition magazine is aligned in the dispensing position. The second ammunition magazine had been aligned adjacent to the first ammunition magazine prior to the removal of the first ammunition magazine through the opening(s).

The present invention relates to a magazine carrier affixed to a holster or a belt. The carrier accepts normal capacity or high capacity magazines and/or magazines with large base pads for use with semiautomatic handguns. A high capacity magazine has an outward appearance that comprises straight walls in the region of the bottom of the magazine and a taper in the sidewalls near the magazine top.

As illustrated in FIGS. 1-9 and discussed in greater detail below, a carrier or housing 1 of the present invention is constructed to allow the user to rapidly dispense magazines 2 from the carrier 1. The carrier 1 consists of six walls forming an enclosure with an opening in one surface from which the magazines 2 are loaded into or dispensed from the carrier 1. The carrier 1 can have either a straight or curved configuration, the latter to follow the user's body contour.

When a magazine 2 is removed from the carrier 1, a next adjacent magazine 2 is urged forward by a pivoting and biasing follower 4 responsive to a force exerted by a spring 41. Action of the follower 4 and the spring 41 move the next magazine 2 into a dispensing position for quick access by the user. As each magazine 2 is loaded into the carrier 1, the pivoting follower 4 is pushed toward a side surface 92 of the carrier 1, compressing the spring 41. See FIG. 6. As each magazine 2 is dispensed from the carrier 1, the pivoting follower 4 is urged in a direction of a side surface 91 by relaxation of the spring 41.

FIG. 1 shows the carrier 1 comprising a front surface 3, a top surface 5, a rear surface 10, a bottom surface 9 and the side surfaces 91 and 92 (the latter not illustrated in FIG. 1 but see FIG. 6) forming a cavity for holding ammunition magazines 2. Although FIG. 1 illustrates the carrier 1 having an approximate rectangular form, the carrier is not limited to this configuration nor to the number of sides/surfaces illustrated in FIG. 1. The carrier may take on a configuration other than a rectangular configuration with more or fewer than six sides/surfaces. Additionally, although FIG. 1 illustrates three ammunition magazines, the carrier 1 may hold fewer or more than three ammunition magazines. As illustrated, the rear surface 10 extends to and is attached to the top surface 5. A top gap 11 is formed between the front surface 3 and the top surface 5, since the rear surface 10, to which the top surface 5 is attached, is longer than the front surface 3. The top gap 11 exposes a top portion of the ammunition magazines 2 held within the carrier 1, as illustrated in FIG. 1.

A cavity formed by the multiple surfaces of the carrier 1 holds a number of magazines 2 for manual withdrawal by the user/wearer. The follower 4 is urged by the spring 41 (see FIG. 6) toward the side surface 91 as each magazine 2 is removed from the carrier 1. As previously mentioned, the carrier 1 may take a different form than that illustrated in FIGS. 1-9, including having a follower with a spring assembly that urges the magazines to a position other than against the side surface 91 or to any side surface, provided that the follower urges the magazines to a dispensing position that is positioned adjacent to one or more opening(s) in the carrier 1.

Figure 2:
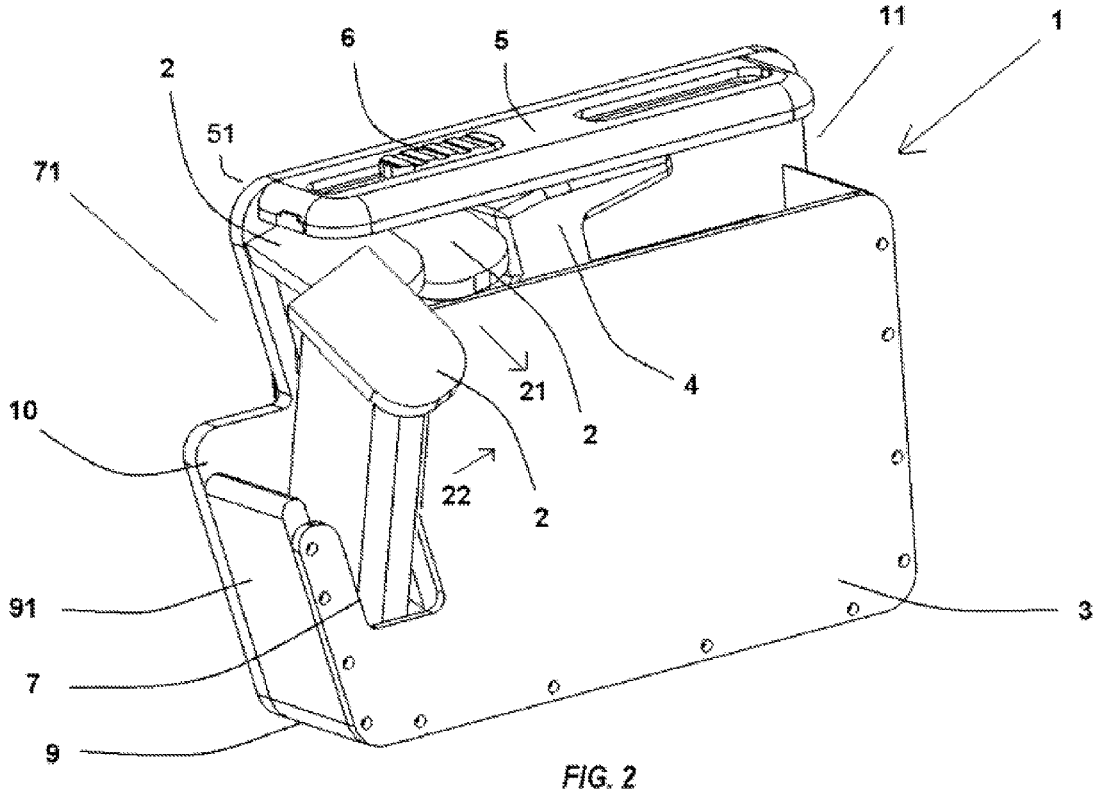
FIG. 2 is an offset front view of the carrier showing a magazine being dispensed through an opening in the front of the carrier.
Figure 3:
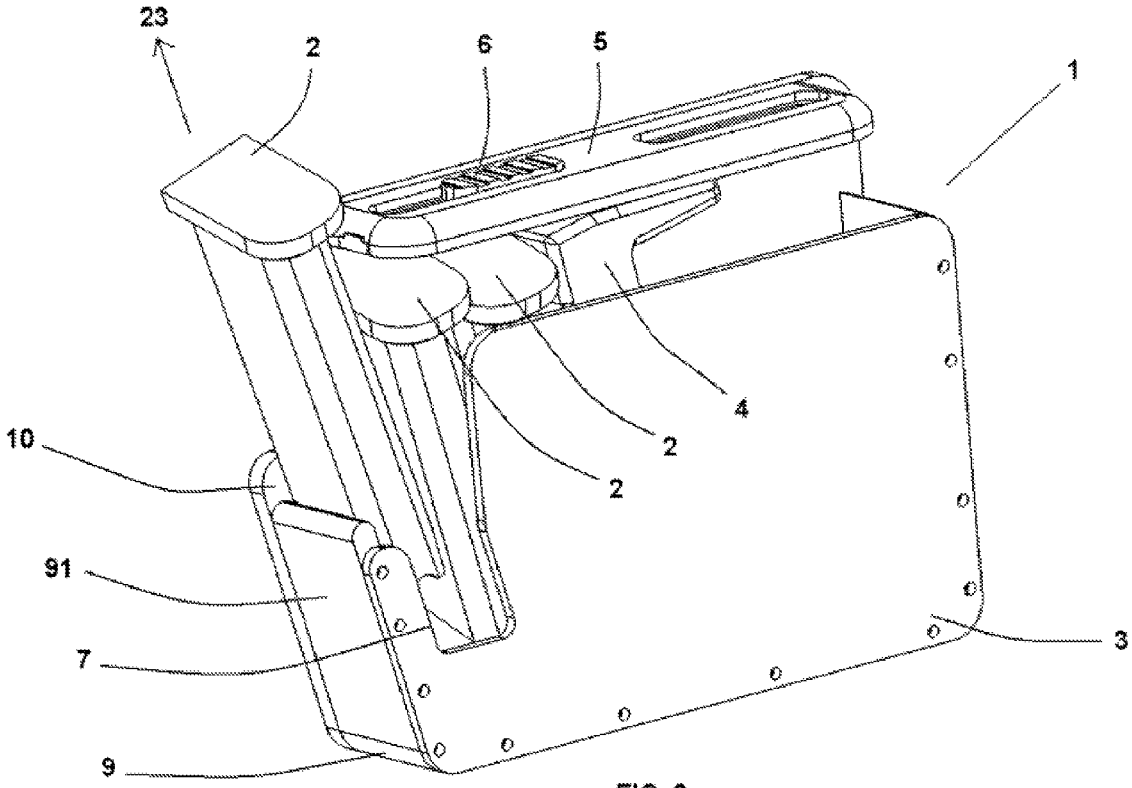
FIG. 3 is an offset front view of the carrier showing a magazine being dispensed through an opening in the top of the carrier.

As illustrated in FIGS. 1-3, a region of the top gap 11 is formed because the top surface 5 is narrower (i.e., has a smaller width) than the bottom surface 9, forming a portion of the gap 11 and exposing an upper region of each one of the magazines 2. A notch or opening 7 is formed in the front surface 3, adjacent to the side surface 91, as shown.

A slide lock 6 formed in the top surface 5 is illustrated in an "off" or ready position in FIGS. 1 and 2. In this ready position a user can extract a magazine from either the notch 7 (as shown in FIG. 2) or vertically through top opening 51 (as shown in FIG. 3). The remaining magazines are pushed forward by action of the spring 41 and the follower 4, subsequent to removal of a magazine through either or both of the notch 7 and/or the top opening 51. The slide lock 6 is switchable between the "off" position (FIGS. 1-2) and the "on" position (FIG. 4), as discussed below.

FIG. 2 shows the carrier 1 with a magazine 2 in a dispensing orientation through the notch 7 and a region of the opening 51. Although the embodiment of FIGS. 1 and 2 describe two openings 7 and 51 for removing a magazine, more or fewer than two openings may be formed in the carrier 1 depending on the configuration of the carrier and/or needs of the user. To withdraw the magazine 2 as illustrated in FIG. 2, the user pushes the magazine 2 slightly (about ¼") in a direction indicated by an arrowhead 22 and into the notch 7. The user then applies a force to a region of a first magazine 2 that is exposed through an opening 71 formed in the rear surface 10. This force is directed generally in a direction of an arrowhead 21 to force the magazine 2 through the notch 7 in the front surface 3. However, the magazine 2 may be withdrawn through the notch/front opening 7 using forces other than those discussed above, and those forces discussed above are merely exemplary.

When the magazine 2 has been removed, the force exerted by the spring 41 urges the self adjusting pivoting follower 4 to push the remaining magazines 2 toward the side surface 91. Another magazine (i.e., second magazine) 2 is then in the dispensing position to be removed by the user. The second magazine shifted into the dispensing position had previously been adjacent the first magazine, prior to removal of the first magazine through one or more of the top opening 51 and/or the notch 7.

FIG. 3 shows the carrier 1 with a magazine 2 being extracted through the top opening 51 in a direction of an arrowhead 23. The user grasps the magazine 2 through the front opening 7 and the notch 71 in the rear surface 10 and pulls the magazine 2 upwardly in the direction of the arrowhead 23. When the magazine is fully removed, the self adjusting pivoting follower 4 pushes the remaining magazines 2 forward toward the surface 91 by the forces exerted by the spring 41 of FIG. 6. As with the embodiments of FIGS. 1-2, the particular forces and/or directions utilized to remove the magazine in the above discussed embodiment of FIG. 3 are merely exemplary and an alternate set of one or more force(s) may be utilized, to accomplish the same result of removing the magazine from the dispensing position through the top opening 51.

Figure 4:
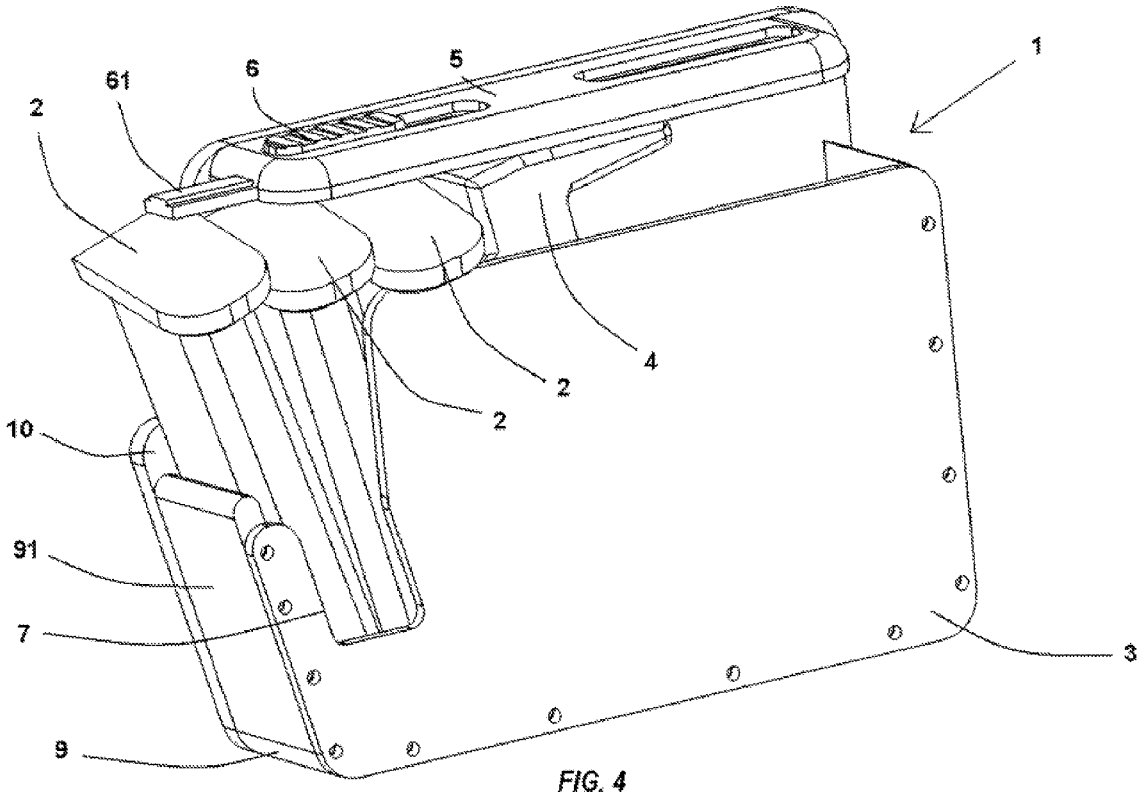
FIG. 4 is an offset front view of the carrier showing the slide lock on, securing the top opening.

FIG. 4 shows the carrier 1 holding a number of magazines 2 with a slide lock 6 in an "on" position with a tab 61 protruding from the top surface 5. With the lock in this position the magazines 2 cannot be removed via the top opening 51 but can be removed via the front opening 7 if needed, by following the description above with reference to FIG. 2.

Although FIGS. 1-4 illustrate the slide lock 6 positioned on/within the top surface 5 and a tab 61 protruding from the top surface 5 when the slide lock 6 is in the "on" position, the slide lock 6 may be positioned at any location within/on the carrier 1 and any structure other than the tab may be utilized that accomplishes the same goal of preventing the magazines from being removed through the top opening 51 when the slide lock is in the "on" position.

Figure 5:
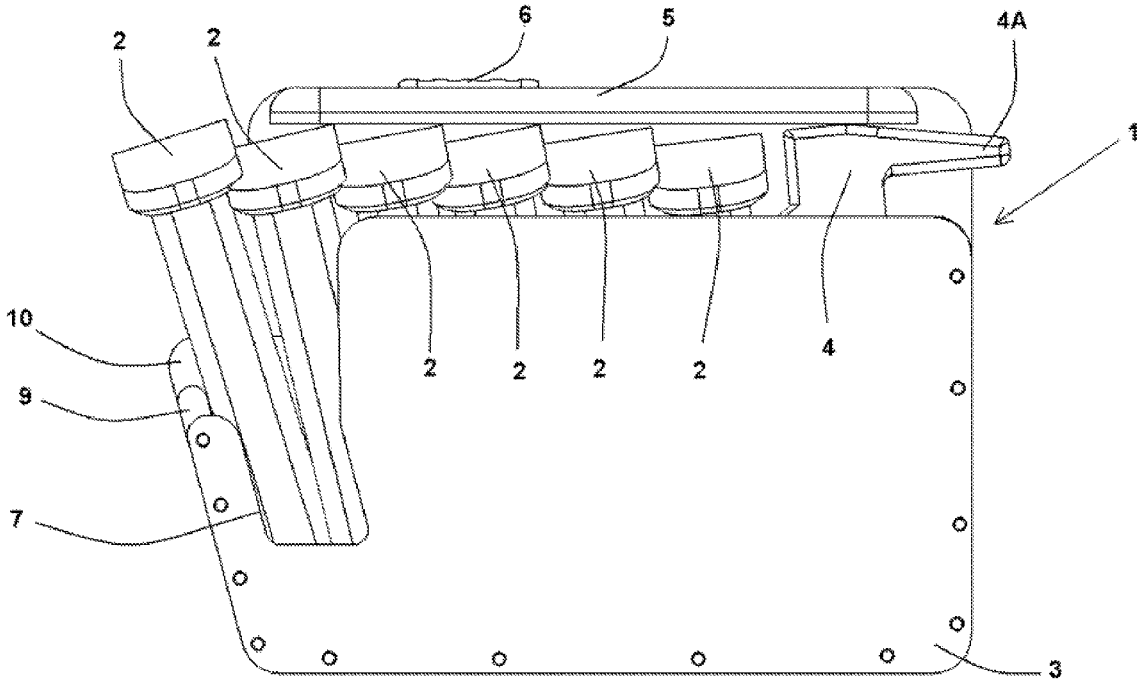
FIG. 5 is a front view of the carrier fully loaded.
Figure 6:
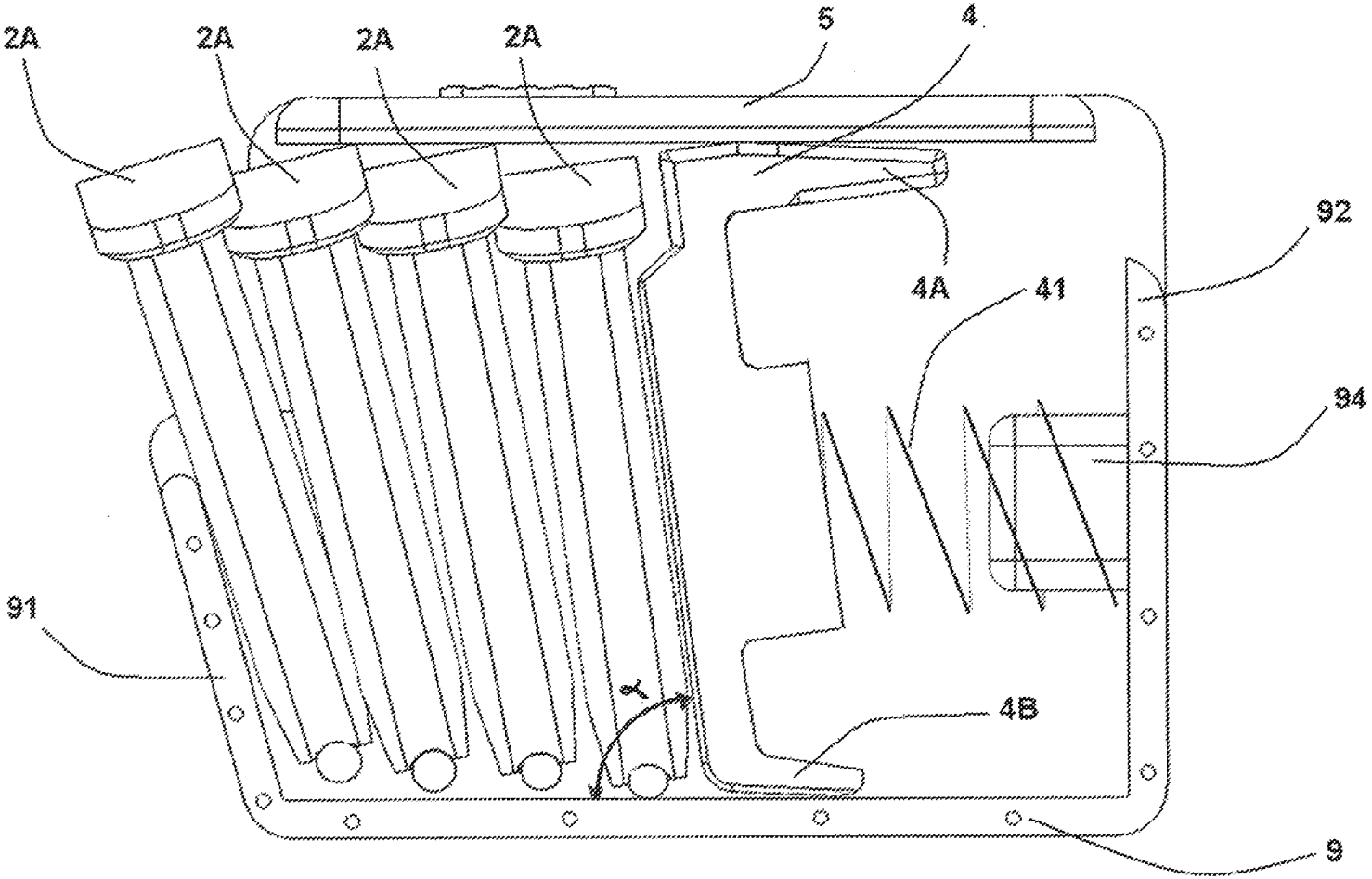
FIGS. 6, 7 and 8 are cut away front views showing the internal structure of the holder with different types of magazines.

FIG. 5 is a side view of the carrier 1 illustrating a number of magazines 2 in the carrier 1. In this view it can be seen that the magazines 2 are disposed at a slight angle to the vertical. As can be seen in FIG. 6, this angle is due to placement of the spring 41 below a horizontal center line of the follower 4 and the angle formed between the side surface 91 and the bottom surface 9. Although FIG. 5 illustrates a particular angular configuration of the magazines 2, the magazines may be angled at any angular configuration other than the configuration illustrated in FIG. 5, including at an orthogonal configuration in which the magazines form an orthogonal direction with the longitudinal axis of the carrier, for example. The spring force exerted in the direction of the side surface 91 causes the magazines to be oriented at an angle as illustrated. Also, from FIG. 6 it can be seen that the follower 4 comprises top and bottom fingers 4A and 4B that slide along inner surfaces of the respective top and bottom surfaces 5 and 9. However, the follower 4 may be formed with top and bottom fingers that do not make contact with the inner surfaces of the respective top and bottom surfaces 5 and 9, for example, provided that the follower ensures that an adequate spring-loaded force is exerted on the magazines and that a farthest magazine from the follower is shifted into the dispensing position adjacent to the side surface 91.

FIG. 6 shows the working components of the carrier 1 with the front surface 3 removed. As can be seen, the self adjusting pivoting follower 4 and the spring 41 urge the high capacity magazines 2A forward to the side surface 91. The spring 41 is held in place at the side surface 92 by capturing a portion of the spring 41 around a boss 94. However, the spring assembly is not limited to the exemplary spring assembly illustrated in FIG. 6, and may include any spring-loaded assembly that provides an adequate spring-loaded force on the magazines, upon removal of a magazine from the top/front opening, so that a second magazine is positioned in the dispensing position adjacent to the top/front opening, for example. An acute angle $\alpha$ is indicated as between a follower surface in contact with at least one of the ammunition magazines 2A and the bottom surface 9.

Figure 7:
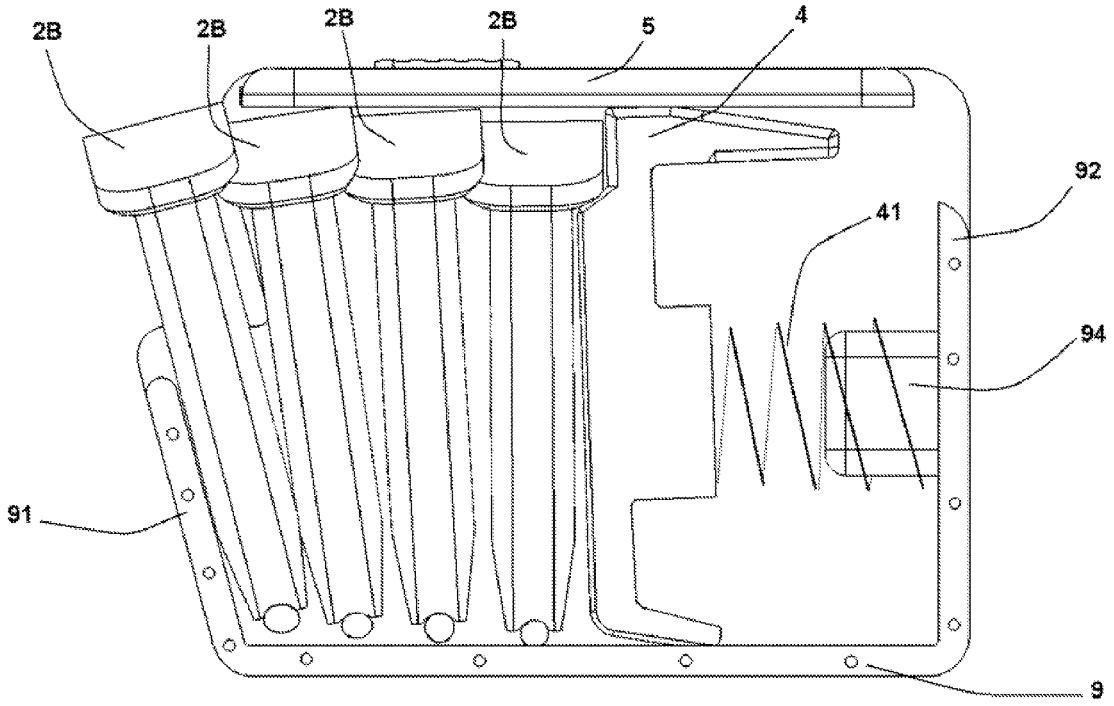

FIG. 7 illustrates the same features as FIG. 6 but the carrier 1 carries large base pad magazines 2B. The follower 4 affects the angle of the magazines.

Figure 8:
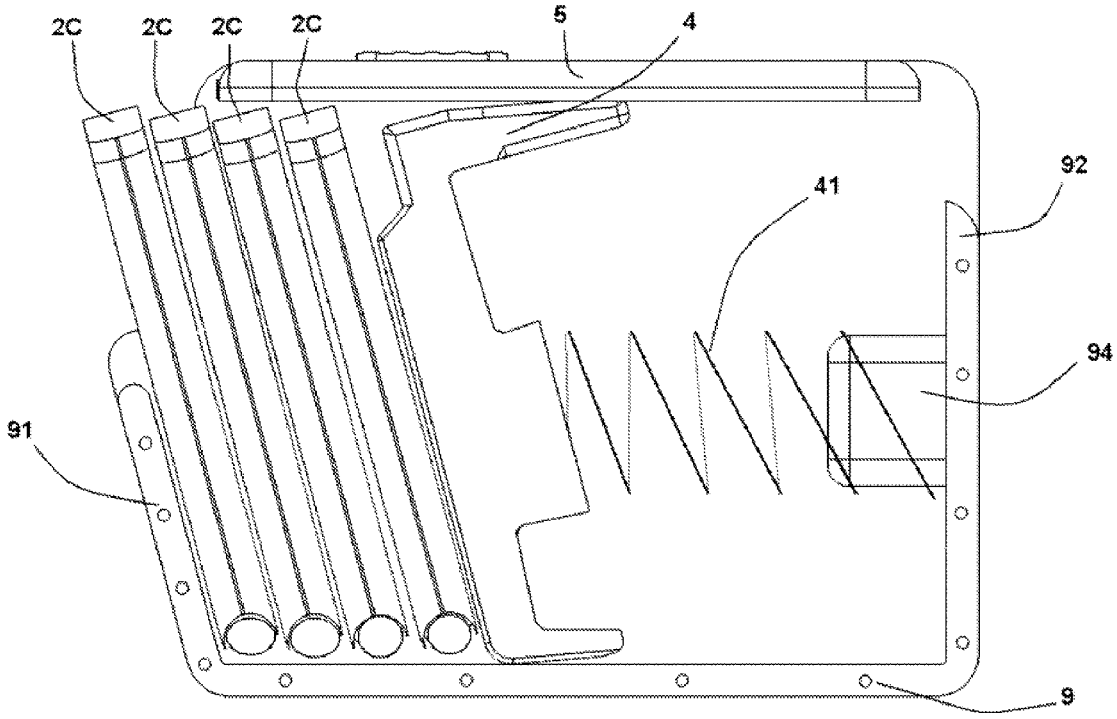

FIG. 8 shows the same features as FIG. 6 but with straight sided (or single stack) magazines 2C. With the off-center spring 41, the follower 4 adjusts the angle of the magazines responsive to a shape of the magazines and a shape (as defined by the sidewalls) of the carrier 1.

Figure 9:
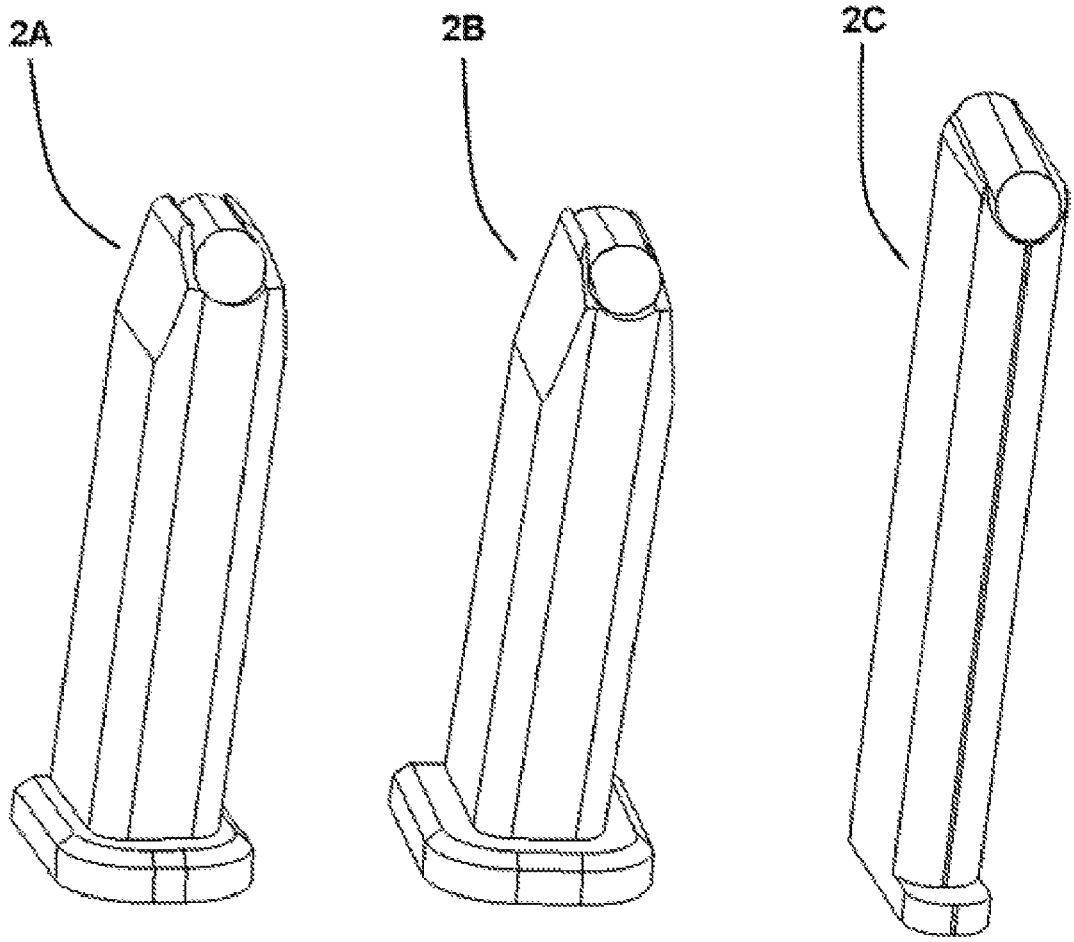
FIG. 9 is an illustration of three different styles of magazines, a standard base pad high capacity magazine, a large base pad high capacity magazine and a single stack magazine.

FIG. 9 illustrates the straight-sided magazines 2C, the high capacity large base pad magazines 2B and the high capacity standard size base pads 2A.

It is recognized by those skilled in the art that the size of the base pad (or the lack of a base pad as in FIG. 8) affects the angle at which the magazines 2 are oriented relative to a vertical line.

The magazine carrier of the present invention offers several advantages over other magazine carriers. The present invention can accommodate high capacity (double stack) magazines, tapered magazines and/or magazines with large base pads. These magazine styles require specialized handling to store and dispense, including but not limited to, an angled end plate or side surface 91 and a pivoting follower.

The angled end plate or side surface 91 allows the magazines to stack without binding and presents the user with easier access to and removal of each magazine. If the side surface 91 and the follower 4 were constructed with vertical surfaces the various types of magazines 2 could not be accommodated.

The pivoting follower 4 allows full contact with the magazines regardless of the angle of the magazines or the quantity of magazines within the carrier. Thus the magazines are held tightly and securely. A flat or vertical and non-pivoting follower cannot hold all types of magazines tightly and securely.

The carrier of the present invention can be assembled for right or left hand use without requiring additional components. This allows an end user to choose the side on which the carrier will be mounted. Thus a retailer can stock only one model of the carrier and end users do not have to "search" for the desired right or left hand model as the user can convert the carrier as required. This can be accomplished by removing screws and any other fasteners holding the various surfaces of the carrier 1 together and reassembling the carrier to accommodate access by the other hand.

Figure 10:
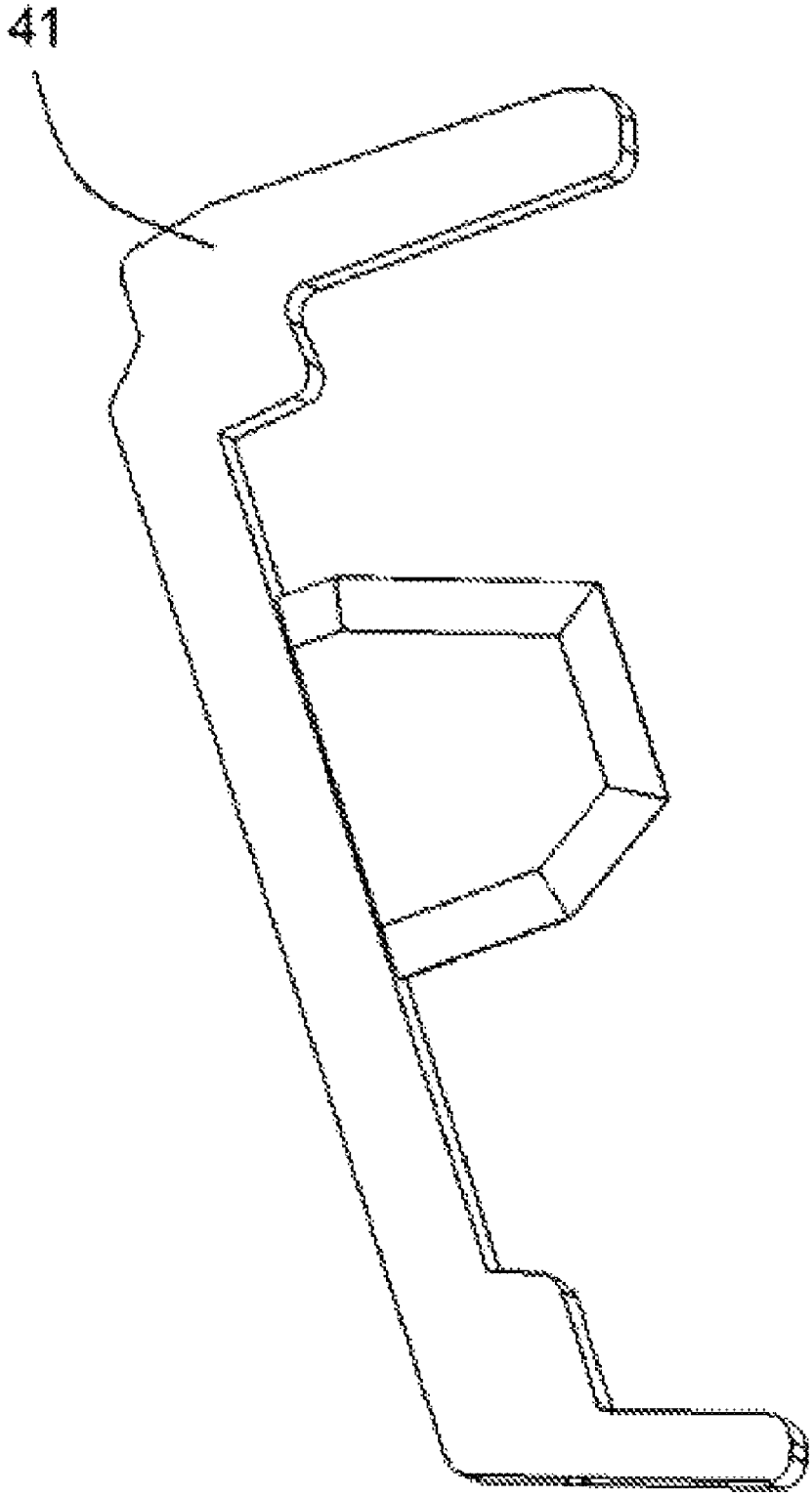
FIG. 10 illustrates an alternative embodiment of the follower.

FIG. 10 illustrates an embodiment of an alternate follower 4', that may be similarly utilized in the various embodiments of the present invention.

Figure 11:
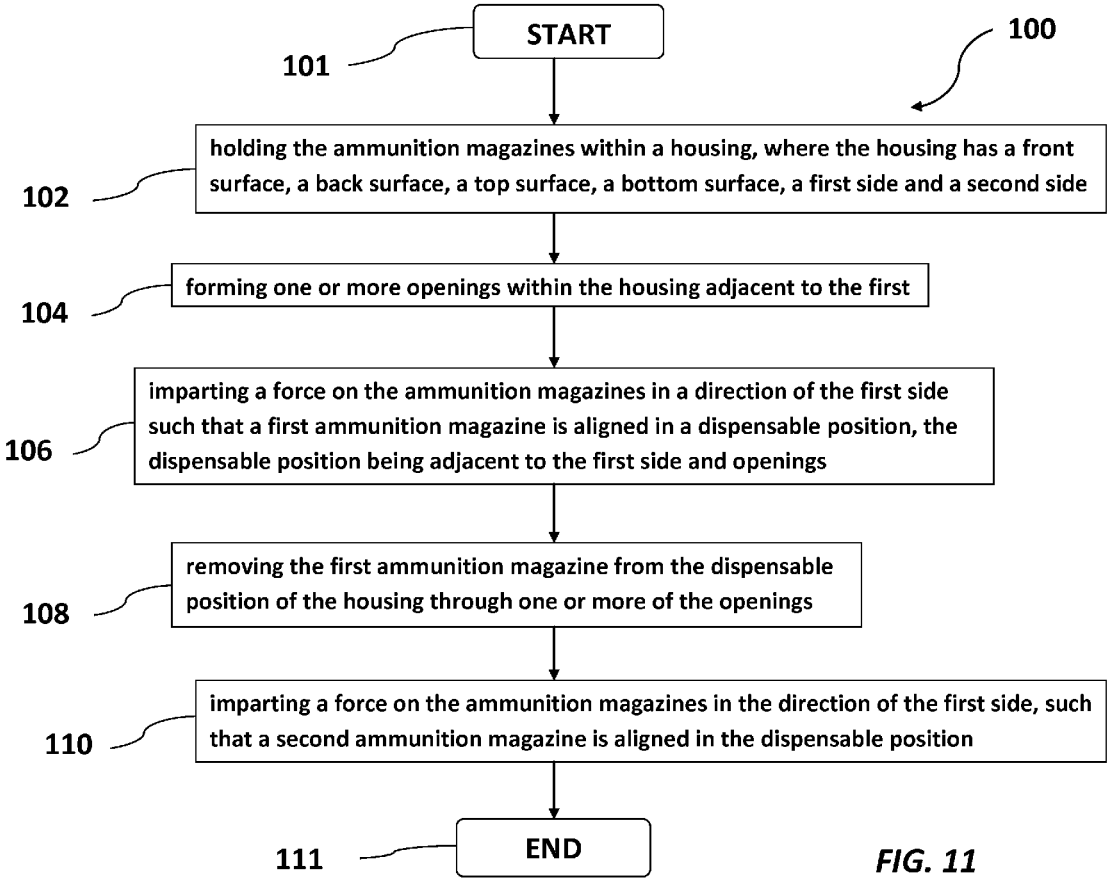
FIG. 11 illustrates a flowchart setting forth steps for removing a ammunition magazine from the carrier of the present invention.

FIG. 11 illustrates an exemplary embodiment of a flowchart depicting a method 100 for individually dispensing ammunition magazines. The method 100 begins at a start step 101 and proceeds to a step 102 where the ammunition magazines 2 are held within a housing 1, where the housing 1 has a front surface 3, a back surface 10, a top surface 5, a bottom surface 9, a first side surface 91 and a second side surface 92. The method 100 further includes a step 104 forming one or more openings 7, 51 within the housing 1 adjacent to the first side 91. The method 100 further includes a step 106 of imparting a force on the ammunition magazines 2 in a direction of the first side 91, such that a first ammunition magazine 2 is aligned in a dispensing position, the dispensing position being adjacent to the first side 91 and the openings 7, 51. The method 100 further includes a step 108 removing the first ammunition magazine 2 from the dispensing position of the housing 1 through one or more of the openings 7, 51. This step is executed by the user exerting a force on the magazine 2 through the opening 71 or through the opening formed by the top surface 5 shorter than the bottom surface 9. The method 100 further includes at a step 110 imparting a force on the ammunition magazines 2 in the direction of the first side 91 such that a second ammunition magazine 2 is aligned in the dispensing position, before ending at 111, where the second ammunition magazine had been aligned adjacent to the first ammunition magazines prior to the removing of the first ammunition magazine through the openings 7,51.

Although one embodiment of the carrier includes the slide lock 6 as described above, this may not be required as the substantial physical contact between adjacent magazines (as illustrated in the FIGS of the application) may create sufficient frictional forces to restrain the magazines 2 within the carrier 1 even if the user is moving vigorously.

As can be seen in the FIGS. an open region is defined in the carrier or housing 1 by the convergence of openings formed in the front surface 3, the side surface 91, the back surface 10 and the top surface 5.

While the present invention has been described with reference to various exemplary embodiments, it will be understood by those skilled in the art that various changes, omissions and/or additions may be made and equivalents may be substituted for elements thereof without departing from the spirit and scope of the invention. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

That which is claimed:

1. A system for individually dispensing ammunition magazines comprising:

ammunition magazines;

a housing configured to hold the ammunition magazines, the housing having a front surface, a back surface, a to surface, a bottom surface, a first side and a second side, the first side forming an obtuse angle with the bottom surface;

a spring-loaded follower configured to impart a force on the ammunition magazines in a direction toward the first side to place a first ammunition magazine in a dispensing position, the dispensing position being the first magazine in contact with the first side, a follower surface in contact with a last one of the ammunition magazines forming an acute angle with the bottom surface, wherein the ammunition magazines are oriented at an angle within the housing to accommodate ammunition magazines having a protruding lip at a top region thereof, the lip causing a width of the magazine top region to be greater than a width of a magazine bottom region;

a spring, wherein a second end of the spring is mounted on an inner surface of the second side of the housing by a boss positioned on the inner surface of the second side, and a first end of the spring is mounted to the follower;

the housing defining an open region to permit access to the first magazine in the dispensing position, the open region defined by the first side shorter than the ammunition magazines, the to surface shorter than the bottom surface, a front opening within the front surface, and a back opening within the back surface;

a surface of each ammunition magazine in the direction of the first side forming an acute angle with the bottom surface;

upon the first ammunition magazine being removed from the housing, the force shifting the ammunition magazines in the direction toward the first side such that a second ammunition magazine moves into the dispensing position, the second ammunition magazine adjacent to the first ammunition magazine prior to removal of the first ammunition magazine; and wherein the first magazine is accessible through the open region such that a user can exert a force on the first magazine and withdraw the first magazine through the open region.

2. The system of claim 1 wherein the front opening within the front surface is based on a groove formed within the front surface.

3. The system of claim 1 wherein the first ammunition magazine is removable from the housing responsive to a user-imparted front-directed force to remove the ammunition magazine through the front opening or a user-imparted top-directed force to remove the ammunition magazine through a top opening defined by the top surface shorter than the bottom surface.

4. The system of claim 1 wherein a top gap is formed between the front surface and the top surface based on a height of the front surface being less than a height of the back surface, the top gap configured to expose a top portion of the ammunition magazines.

5. The system of claim 1 wherein the ammunition magazines are oriented at an angle within the housing based on a mounting position of the first end of the spring to the follower relative to a horizontal center line of the follower.

6. The system of claim 5 wherein the follower comprises a top finger and a bottom finger, wherein the top and bottom fingers respectively slide along an inner surface of the respective top surface and the bottom surface to retain the ammunition magazines at the angle within the housing.

7. The system of claim 1 wherein the follower comprises a top finger and a bottom finger, wherein the top and bottom fingers respectively slide along an inner surface of the respective top surface and the bottom surface during a shift of the ammunition magazines such that the second ammunition magazine is shifted into the dispensing position.

8. The system of claim 1 further comprising a slide lock mounted to the top surface, the lock slidable between an unlocked position in which the ammunition magazines are removable from the dispensing position through the open region responsive to a top-directed force, and a locked position in which a tab extends into the open region to block the ammunition magazines from being removable from the dispensing position responsive to a top-directed force.

9. The system of claim 1 wherein the side opening is formed by the first side surface shorter than the second side surface.

* * * * *